US012144443B2

(12) United States Patent
Spiro et al.

(10) Patent No.: US 12,144,443 B2
(45) Date of Patent: Nov. 19, 2024

(54) UNIVERSAL HANGING MOUNT

(71) Applicant: Tracer Imaging LLC, Ossining, NY (US)

(72) Inventors: Steven M. Spiro, Chappaqua, NY (US); Ryan Kelly, Astoria, NY (US); Jessica Huffman, Elmsford, NY (US)

(73) Assignee: Tracer Imaging LLC, Ossining, NY (US)

( * ) Notice: Subject to any disclaimer, the term of this patent is extended or adjusted under 35 U.S.C. 154(b) by 1 day.

(21) Appl. No.: 18/088,187

(22) Filed: Dec. 23, 2022

(65) Prior Publication Data

US 2023/0200570 A1 Jun. 29, 2023

Related U.S. Application Data

(60) Provisional application No. 63/294,513, filed on Dec. 29, 2021.

(51) Int. Cl.
*A47G 1/16* (2006.01)
*A47G 1/17* (2006.01)

(52) U.S. Cl.
CPC ..... *A47G 1/1626* (2013.01); *A47G 1/17* (2013.01)

(58) Field of Classification Search
CPC ..... A47G 1/1626; A47G 1/17; A47G 1/1606
USPC ..... 248/475.1
See application file for complete search history.

(56) References Cited

U.S. PATENT DOCUMENTS 2,757,890 A * 8/1956 Sutton ..... A47G 1/1606 248/494
3,955,790 A * 5/1976 Ballin ..... A47G 1/1606 33/391
2003/0046845 A1* 3/2003 Boddie ..... G09F 7/04 40/600
2012/0204803 A1* 8/2012 Sprung ..... B24D 99/00 119/264
2017/0063000 A1* 3/2017 Seger ..... H01R 13/518
2018/0027997 A1* 2/2018 Kressin ..... A47G 1/02
2021/0372559 A1* 12/2021 Yang ..... F21V 21/02

* cited by examiner

*Primary Examiner* — Muhammad Ijaz
(74) *Attorney, Agent, or Firm* — Leason Ellis LLP

(57) ABSTRACT

A universal hanging mount includes a first substrate having a front face and a rear face. A mounting plate is coupled to the front face. The mounting plate has a rear face that is in contact with the front face of the first substrate and an opposite front face. A plurality of hanging adapters that are formed along the front face of the mounting plate. At least two of the plurality of the hanging adapters are different types of hanging adapters that are configured to mate with different types of hanging hardware that is located along a rear of a frame article.

13 Claims, 3 Drawing Sheets

UNIVERSAL HANGING MOUNT

CROSS-REFERENCE TO RELATED PATENT APPLICATIONS

This application is based on and claims priority to U.S. Provisional Patent Application 63/294,513, filed Dec. 29, 2021, the entire contents of which is incorporated by reference herein as if expressly set forth in its respective entirety herein.

TECHNICAL FIELD

The present disclosure is directed to hanging hardware that is configured to mount a framed article to a support surface, such as a wall, and more particularly to a universal hanging mount that includes a plurality of different adapters that are each configured to attach to complementary hanging hardware that is part of the framed article.

BRIEF DESCRIPTION OF THE DRAWING FIGURES

SUMMARY

A universal hanging mount includes a first substrate having a front face and a rear face. A mounting plate is coupled to the front face. The mounting plate has a rear face that is in contact with the front face of the first substrate and an opposite front face. A plurality of hanging adapters that are formed along the front face of the mounting plate. At least two of the plurality of the hanging adapters are different types of hanging adapters that are configured to mate with different types of hanging hardware that is located along a rear of a frame article.

DETAILED DESCRIPTION OF CERTAIN EMBODIMENTS

Figure 1:
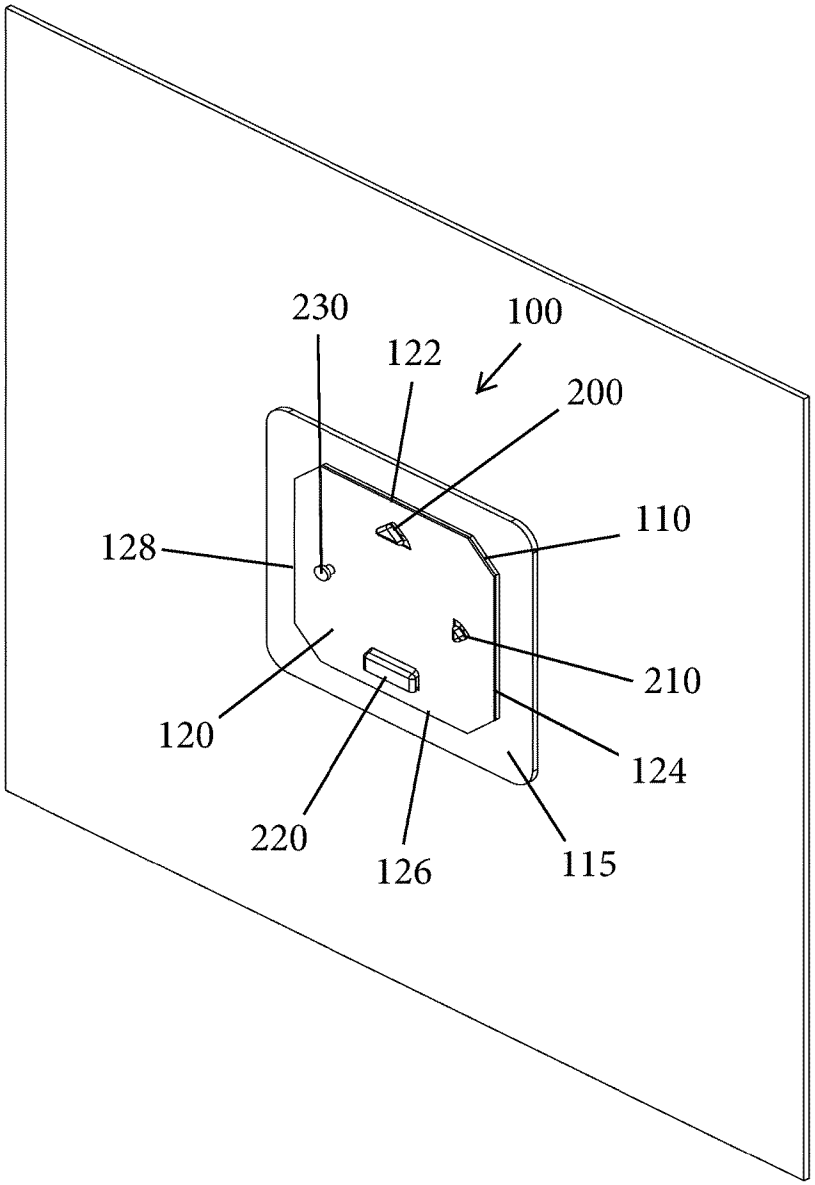
FIG. 1 is a front perspective view of a universal hanging mount according to one embodiment.
Figure 2:
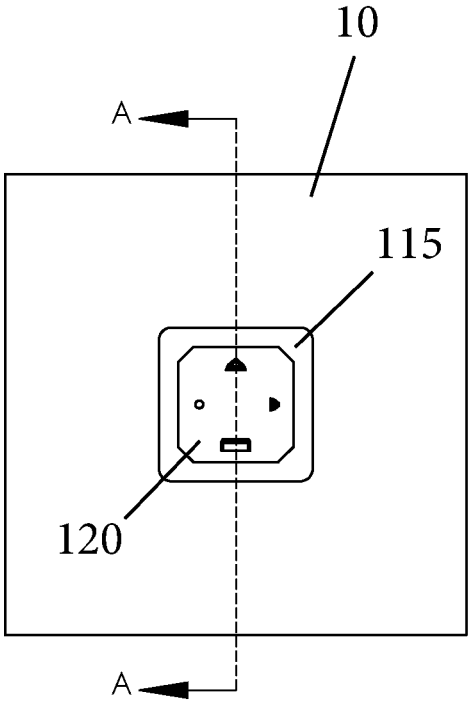
FIG. 2 is a front elevation view thereof.
Figure 3:
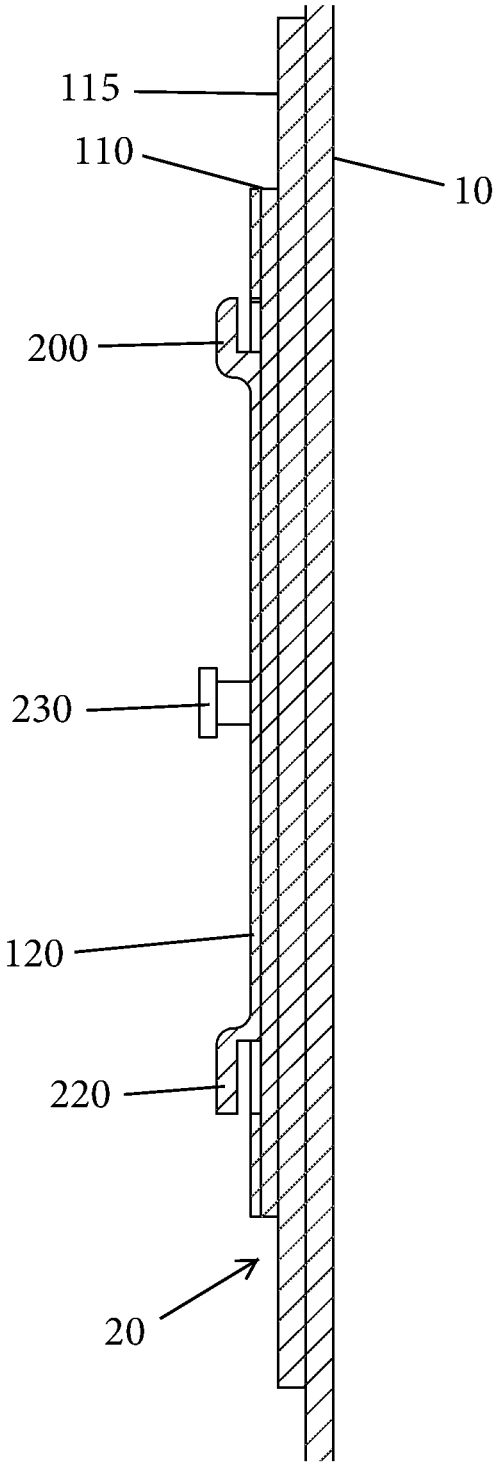
FIG. 3 is a cross-sectional view taken along the line A-A.

FIGS. 1-3 illustrated one exemplary universal hanging mount 100 that can be part of a mounting system 20. The universal hanging mount 100 includes a first substrate 110 that can have any number of different shapes and sizes. In the illustrated embodiment, the first substrate 110 has a rectangular shape. The first substrate 110 can be formed of either a magnetic material or a ferro magnetic material. In the illustrated embodiment, the first substrate 110 is formed of a magnetic material (e.g., rigid or flexible magnet sheet).

The first substrate 110 is intended to be seated against and detachably coupled to a second substrate 115 that is for placement along the support surface 10. The support surface 10 is typically a wall or the like. The second substrate 115 can be attached to the support surface 10 using any number of traditional techniques, including but not limited to use of fasteners, an adhesive, etc. When an adhesive is used, the adhesive can be in the form of an adhesive layer formed along the rear face of the second substrate 115.

The second substrate 115 is complementary to the first substrate 110 and along with the first substrate 110 can define a magnetic system. When the first substrate 110 is a magnet, the second substrate 115 is formed of a magnet receptive material (e.g., ferro magnetic material). Thus, when the two substrates 110, 115 are placed in contact, the two substrate 110, 115 are detachably coupled to one another.

The universal hanging mount 100 also includes a mounting plate 120 that is coupled to front face 111 of the first substrate 110. The mounting plate 120 can be attached to the second substrate 115 using any number of traditional techniques, including but not limited to use of fasteners, an adhesive, etc. When an adhesive is used, the adhesive can be in the form of an adhesive layer formed along the rear face of the mounting plate 120.

The mounting plate 120 can, as shown, have the same footprint compared to the first substrate 110. The mounting plate 120 is typically formed of a different material than the first substrate 110. For example, the mounting plate 120 can be formed of a rigid material, such as a plastic (e.g., molded plastic).

The mounting plate 120 has a first edge 122, a second edge 124, a third edge 126, and a fourth edge 128. The first and third edges 122, 126 are opposite one another and the second and fourth edges 124, 128 are opposite one another.

The front face 111 of the first substrate 110 includes a plurality of hanging adapters that provide the universal nature of the disclosed product (universal hanging mount 100). For example, the plurality of hanging adapters includes at least two hanging adapters and more particularly, includes a first hanging adapter 200, a second hanging adapter 210, a third hanging adapter 220 and a fourth hanging adapter 230.

In the illustrated embodiment, the first hanging adapter 200 is formed along the first edge 122, the second hanging adapter 210 is formed along the second edge 124, the third hanging adapter 220 is formed along the third edge 126 and the fourth hanging adapter 240 is formed along the fourth edge 128. The different hanging adapters are configured to mate with different hanging hardware (not shown) that is part of a framed article (not shown) to be mounted to the support surface 10.

The combined mounting plate 120 and the first substrate 110 can be considered to define a first part of the mounting system 20 and the second substrate 115 can be considered to define a second part of the mounting system 20.

It will be appreciated that the combined mounting plate 120 and the first substrate 110 is oriented so as to place the selected adapter in the desired location which is typically in a location that the selected adapter is at the top (selected adapter is uppermost adapter on the mounting plate 120).

The first hanging adapter 200 can be in the form of a cable adapter that is configured to receive a cable or wire that is part of the framed article and intended for hanging the framed article on the support surface 10.

The second hanging adapter 210 can be in the form of a sawtooth adapter that is configured to mate with a sawtooth hook (not shown) that is part of the framed article.

The third hanging adapter 220 can be in the form of French cleat adapter that is configured to mate with a French cleat (not shown) that is part of the framed article. As is known, a French cleat is a way of securing a cabinet, mirror, artwork or other object to a wall. It is a molding with a 30-45 degree slope used to hang cabinets or other objects. The wall side of a French cleat can be mounted securely without having to hold the full weight of the cabinet while securing it.

The fourth hanging adapter 230 can be in the form of a nail adapter that is configured to receive a nail (fastener) (not shown) that is part of the framed article.

The relative locations of the first, second, third and fourth hanging adapters 200, 210, 220, 230 are not limiting and are only exemplary.

Since the combined mounting plate 120 and the first substrate 110 can be readily reoriented relative to the second substrate 115, the user can easily rotate and reposition the combined mounting plate 120 and first substrate 110 so that the desired hanging adapter is in the desired position relative to the others and relative to the second substrate 115 and the support surface 10.

The universal hanging mount 100 is universal in nature since it provides the user with multiple types of hanging adapters to select from based on the type of hanging hardware that is part of the framed article that is to be mounted to the support surface (wall). For example, if the user has a first framed article that has a wire as the hanging hardware, then the first hanging adapter 200 is to be used and the combined mounting plate 120 and first substrate 110 is oriented to position the first hanging adapter 200 at the top to allow the wire to be supported by the first hanging adapter 200.

If the user instead has a framed article with a sawtooth hook, the user positions the second hanging adapter 210 at the top to allow the sawtooth hook is mated and engages the second hanging adapter (sawtooth adapter) 210.

The universal nature allows the user to purchase this single mount and change the framed article to be displayed throughout the year without having to purchase different mounting hardware in the event that the framed articles include different handing hardware.

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A universal hanging mount comprising:

a first substrate having a front face and a rear face;

a mounting plate that is coupled to the front face, the mounting plate having a rear face that is in contact with the front face of the first substrate and an opposite front face; and a plurality of hanging adapters that are each formed along the front face of the mounting plate;

wherein the plurality of hanging adapters includes a cable adapter configured to receive a cable or wire, a sawtooth adapter configured to engage a sawtooth hook, a French cleat adapter configured to engage a French cleat, and a nail adapter configured to receive a nail;

wherein the cable adapter lies above each of the sawtooth adapter, the French cleat adapter and the nail adapter such that a plane that is parallel to a top edge of the first substrate and passes through the cable adapter does not intersect each of the sawtooth adapter, the French cleat adapter and the nail adapter.

2. The universal hanging mount of claim 1, wherein the first substrate comprises one of a magnet substrate and a magnetic receptive substrate.

3. The universal hanging mount of claim 1, wherein the mounting plate comprises a rigid plastic plate that is adhesively secured to the first substrate.

4. The universal hanging mount of claim 3, wherein the mounting plate comprises a plastic molded part.

5. The universal hanging mount of claim 1, wherein the mounting plate and the first substrate have aligned perimeter edges.

6. The universal hanging mount of claim 1, wherein the plurality of hanging adapters are integrally formed with the mounting plate.

7. The universal hanging mount of claim 6, wherein the plurality of hanging adapters comprise at least two hanging adapters formed along opposite edges of the mounting plate.

8. The universal hanging mount of claim 1, wherein the mounting plate has four sides and the plurality of hanging adapters comprises four adapters, each hanging adapter being located along one side of the mounting plate.

9. The universal hanging mount of claim 8, wherein the four adapters are located 90 degrees apart from one another.

10. A universal hanging mount system comprising:

a first substrate having a front face and a rear face;

a mounting plate that is coupled to the front face of the first substrate, the mounting plate having a rear face that is in contact with the front face of the first substrate and an opposite front face;

a plurality of hanging adapters that are formed along a front face of the mounting plate; and a second substrate to which the first substrate is coupled for detachably securing the mounting plate to the second substrate, the second substrate having a flat front face and a flat rear face, the rear face of the first substrate being in direct contact with the flat front face of the second substrate;

wherein the first substrate comprises one of a magnet substrate and a magnetic receptive substrate and the second substrate comprises the other of the magnet substrate and the magnetic receptive substrate; and wherein a footprint of the second substrate is larger than a footprint of the first substrate.

11. The universal hanging mount system of claim 10, wherein the first substrate comprises the magnet substrate and the second substrate comprises the magnetic receptive substrate to permit the first and second substrates to be attached to one another by magnetic attraction.

12. The universal hanging mount system of claim 10, wherein the mounting plate is adhesively attached to the first substrate.

13. The universal hanging mount system of claim 10, wherein the mounting plate and the first substrate have overlapping perimeter edges.

* * * * *